US009125534B2

(12) United States Patent
Kim et al.

(10) Patent No.: US 9,125,534 B2
(45) Date of Patent: Sep. 8, 2015

(54) VACUUM CLEANER

(71) Applicants: Youngho Kim, Changwon-si (KR); Seogyong Kim, Changwon-si (KR); Jinwoo Lee, Changwon-si (KR)

(72) Inventors: Youngho Kim, Changwon-si (KR); Seogyong Kim, Changwon-si (KR); Jinwoo Lee, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 129 days.

(21) Appl. No.: 13/765,812

(22) Filed: Feb. 13, 2013

(65) Prior Publication Data

US 2014/0059797 A1 Mar. 6, 2014

(30) Foreign Application Priority Data

Aug. 31, 2012 (KR) ..... 10-2012-0096176

(51) Int. Cl.

| | |
|---|---|
| ***A47L 9/26*** | (2006.01) |
| ***A47L 9/16*** | (2006.01) |
| ***A47L 9/12*** | (2006.01) |
| ***A47L 5/36*** | (2006.01) |

(52) U.S. Cl.

CPC . *A47L 9/16* (2013.01); *A47L 5/362* (2013.01); *A47L 9/122* (2013.01); *A47L 9/1608* (2013.01); *A47L 9/1683* (2013.01); *A47L 9/1691* (2013.01)

(58) Field of Classification Search

CPC ..... A47L 5/362; A47L 5/365; A47L 5/14; A47L 9/00; A47L 9/127; A47L 7/0028; A47L 7/0038; A47L 7/0042

USPC ..... 15/327.1, 327.2, 347, 350, 352, 353; 55/320, 322, 337, 339, 344, 348, 419

See application file for complete search history.

(56) References Cited

U.S. PATENT DOCUMENTS

| | | | | |
|---|---|---|---|---|
| 6,735,816 | B2 * | 5/2004 | Oh et al. | 15/353 |
| 6,840,972 | B1 * | 1/2005 | Kim | 55/337 |
| 7,882,592 | B2 * | 2/2011 | Hwang et al. | 15/353 |
| 8,316,507 | B2 * | 11/2012 | Hyun et al. | 15/353 |
| 2002/0088078 | A1 | 7/2002 | Oh et al. | |
| 2009/0178232 | A1 * | 7/2009 | Hyun et al. | 15/347 |
| 2010/0205915 | A1 | 8/2010 | Oh | |
| 2010/0263161 | A1 | 10/2010 | Lee et al. | |

FOREIGN PATENT DOCUMENTS

| | | |
|---|---|---|
| DE | 10 2005 014 542 | 4/2006 |
| EP | 0 489 468 | 6/1992 |
| EP | 1 371 318 A2 | 12/2003 |

(Continued)

OTHER PUBLICATIONS

Australian Office Action dated Dec. 20, 2013 for corresponding Application No. 2013201067.

(Continued)

*Primary Examiner* — Dung Van Nguyen

(74) *Attorney, Agent, or Firm* — Ked & Associates LLP

(57) ABSTRACT

A vacuum cleaner is provided, and in particular, a vacuum cleaner having a dust container that holds dust, and a dust separator that separates the dust from air. The vacuum cleaner may, include a body including a fan mounting portion configured to receive a fan mounted thereto, a dust separator provided to one side of the fan mounting portion that draws in air by a suction force of the fan to separate dust from the air by a cyclone principle, and a dust container provided to or at an outside of the dust separator and separable from the dust separator, that holds the dust separated at the dust separator.

33 Claims, 10 Drawing Sheets

(56) References Cited

FOREIGN PATENT DOCUMENTS

| | | | |
|---|---|---|---|
| EP | 1 935 309 | | 6/2008 |
| GB | 2 460 536 | A | 12/2009 |
| JP | 2003-153840 | | 5/2003 |
| KR | 10-0623916 | | 9/2006 |
| KR | 10-0667877 | | 1/2007 |
| KR | 10-2010-0010162 | A | 2/2010 |
| KR | 10-2010-0018778 | | 2/2010 |
| KR | 10-2010-0018786 | | 2/2010 |
| KR | 10-2010-0041650 | | 4/2010 |
| WO | WO 01/60226 | | 8/2001 |
| WO | WO 2012059666 | A1 | 5/2012 |

OTHER PUBLICATIONS

Korean Notice of Allowance issued on May 22, 2014 in Application No. 10-2012-0096176.

European Search Report dated Nov. 12, 2013.

European Search Report dated Feb. 17, 2014.

* cited by examiner

VACUUM CLEANER

CROSS-REFERENCE TO RELATED APPLICATION(S)

This application claims priority to Korean Patent Application No. 10-2012-0096176, filed in Korea on Aug. 31, 2012, which is hereby incorporated by reference as if fully set forth herein.

BACKGROUND

1. Field

A vacuum cleaner is disclosed herein.

2. Background

Vacuum cleaners are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
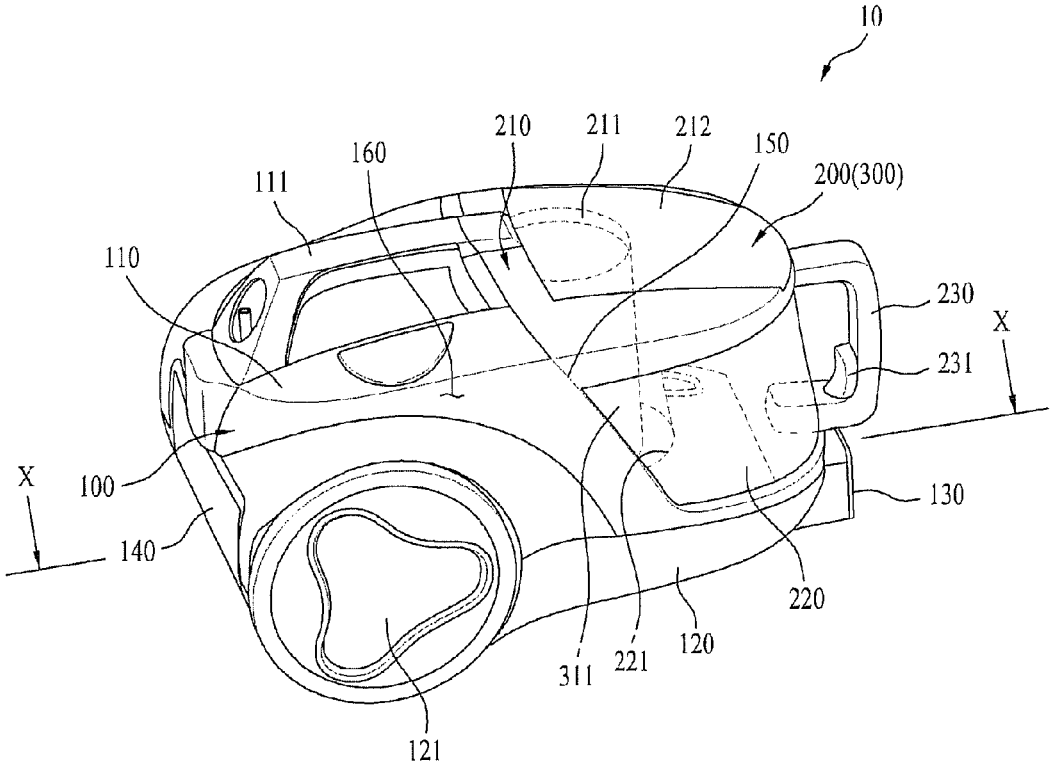
FIG. 1 is a perspective view of a vacuum cleaner in accordance with an embodiment.

Reference will now be made in detail to the embodiments, examples of which are illustrated in the accompanying drawings. Wherever possible, like reference numbers have been used throughout the drawings to refer to the same or like parts.

A vacuum cleaner is an apparatus that draws air therein and filters foreign matter, such as dust, from the air within a main body thereof. In general, such a vacuum cleaner is provided with the main body having a fan motor built-therein to produce a suction force, a suction nozzle that draws in the foreign matter and air from a floor surface, and a dust collection device that filters the foreign matter. In this application, such a vacuum cleaner will be referred to as a cleaner, for convenience's sake.

There are a variety of types of cleaners including a type in which a dust bag is used, a cyclone type, and a type using a filter that filters the foreign matter or the dust from the air thus drawn in. More recently, vacuum cleaners have been widely used, in which a dust container that holds the dust, and a dust separator that separates the dust are provided. As one example of such a vacuum cleaner, the cyclone type vacuum cleaner is widely used to filter foreign matter from air using a cyclone. Further, vacuum cleaners are also widely used, which use both a cyclone and a filter.

The cyclone type vacuum cleaner may include the dust separator that filters the foreign matter from the air thus drawn in using a centrifugal force. That is, the dust separator may include a device that produces a cyclone. The dust separated at or in the dust separator may be held in the dust container.

In general, the dust separator and the dust container may be formed as one unit. Accordingly, the dust separator and the dust container may be referred to as a cyclone dust collector, collectively. Korea Laid Open Patent Publication No. 10-2009-0118804 discloses an example of such a cyclone dust collector.

In order to empty the dust container, a user is required to separate the cyclone dust collector from the main body. That is, it is required that, not only the dust container, but also the dust separator be separated from the main body at the same time. However, emptying the dust is not easy due to a weight of the cyclone dust collector. Further, the dust container and the dust separator formed as one unit may cause a problem in that a structure of the cyclone dust collector becomes complicated and fabrication thereof difficult.

Related art cyclone dust collectors may have the dust container formed on an inside of the dust separator as one unit. Accordingly, for effective movement of the dust from the dust separator to the dust container, a dust moving passage may be formed along an outside circumference of a top side of the dust separator. In other words, the dust moving passage may be formed extending throughout an entire top side of the dust separator. Such a dust moving passage may have a problem in that the dust is likely to fly back from the dust container to the dust separator making the dust enter into the dust separator again, causing a problem in that dust separating efficiency becomes poor.

Further, related art cyclone dust collectors may enclose the dust separator and the dust container from the outside with one cover. As the dust separator and the dust container function different from each other, frequencies of dust emptying or water washing may be different from each other. For example, the dust container may require dust emptying or water washing to be carried out more frequently than the dust separator. Consequently, in a case of one cyclone dust collector, there may be a case in which the dust separator is emptied or water washed more than required. This is because a basic function of the dust separator is not holding the dust, but separating the dust from the air.

Of course, if a relatively large piece of paper is introduced into the dust separator, the large piece of paper sheet may not be introduced easily to the dust container. The large piece of paper sheet may interfere with an air flow in the dust separator. Accordingly, in order to reduce noise and perform effective dust suction, it may be necessary to remove the large piece of paper from the dust separator, at that time. In this case, there is a problem in that both the dust separator and the dust container are exposed to the outside of the cyclone dust collector by removing or opening the cover. Consequently, there is a problem of exposing even also the dust container to merely remove the large piece of paper from the dust separator.

Along with this, it has not been easy to inspect an inside of the dust separator from an outside of the related art cleaner. In other words, as described above, the user may have difficulty in determining whether or not the large piece of paper, which may interfere with dust separation, is present in the dust separator. This is because the dust separator is in the dust container, so the user is unable to see an inside of the dust separator from an outside of the cleaner due to the dust in the dust container.

In the meantime, in view of nature of the cleaner, the air is introduced to the main body, and flows out of the main body passing through the cyclone dust collector. Therefore, the air flow in the body is smooth. This is because the smooth air flow means increased cleaner efficiency. Therefore, an eternal task in the field of cleaners is designing an effective flow passage which can reduce air flow resistance in the main body, and improve positions and coupling relations among elements of the flow passage to form the smooth air flow.

FIG. 1 illustrates a canister type cleaner body as an example of a cleaner in accordance with an embodiment. Configurations of a suction nozzle and suction pipe are not shown. However, such configurations are well known.

Embodiments disclosed herein are applicable, not only to the canister type cleaners, but also to other type of cleaners, such as an upright type cleaner. In other words, technical features of the disclosed embodiments are applicable to any type cleaner which draws dust and air into a body, and separates the dust from the air to discharge the air from the body.

The cleaner 10 of FIG. 1 may include a main body 100 having a body inlet 130 for introduction of air and dust to the cleaner 10, and a body outlet 140 that discharges the air from the cleaner 10. A fan (not shown) may be mounted in the main body 100 to produce an air flow between the body inlet 130 and the body outlet 140. The fan may form an assembly with a motor (not shown) that drives the fan. The assembly may be referred to as a fan drive 400 (see FIG. 10). A fan mounting portion 160 may be provided in the main body 100 to receive the fan drive 400 mounted thereto.

Referring to FIG. 1, the body inlet 130 and the body outlet 140 may be on a substantially straight line. That is, the body inlet 130 and the body outlet 140 may be on a substantially straight line extending in a lengthwise direction of the main body 100. Further, the body inlet 130 may be provided to or at a lower side of the main body 100, and the body outlet 140 may be also provided to or at the lower side of the main body 100. Due to such positions of the body inlet 130 and the body outlet 140, a smooth air flow passage may be formed in the main body 100.

The body inlet 130 and the body outlet 140 may be provided to or in a lower body 120 to be described hereinbelow. Accordingly, an air flow path in the main body 100 may be minimized, and unpleasant feelings caused by the air being discharged may be minimized, as the air is discharged and introduced to the main body 100 close to a floor.

The portion containing the body inlet 130 may be referred to as a front of the main body 100 of the cleaner 10, and the portion containing body outlet 140 may be referred to as a rear of the main body 100 of the cleaner 10. Therefore, for convenience of description, in this specification, a front direction of the cleaner 10 may be referred to as a body inlet direction, and a rear direction of the cleaner 10 may be referred to as a body outlet direction.

As described above, due to operation of the fan drive 400, air may be introduced from outside of the main body 100 through the body inlet 130, and may be discharged from the body outlet 140 after passing by or through the fan drive 400. A dust separator 300 may be provided in the air flow passage to separate dust from the air, as well as a dust container 200 to hold the dust thus separated.

The dust separator 300 and the dust container 200 may be provided to or at an outside of the main body 100. The dust separator 300 and the dust container 200 may be configured to be coupled easily to and decoupled from the main body 100. Therefore, the air introduced to an inside of the main body 100 may be introduced to the dust separator 300 on the outside of the main body 100, reintroduced to an inside of the main body 100, and discharged to the outside of the main body 100 through the fan drive 400 and the body outlet 140.

The dust separator 300 and the dust container 200 may be provided to or at a seating portion 150 formed on the outside of the main body 100 to receive the dust separator 300 and the dust container 200 mounted thereon. The seating portion 150 may be formed on one side of the fan mounting portion 160. That is, the fan mounting portion 160 may be provided to or at an inside of one side (a rear side) of the main body 100, and the seating portion 150 may be provided to the other side (a front side) of the main body 100.

Referring to FIG. 1, the main body 100 may include an upper body 110 and the lower body 120. Coupling of the two may form an inside space between the upper body 110 and the lower body 120, in which the fan mounting portion 160 may be provided. The air flow passage may be provided in the inside space. The upper body 110 may form an upper exterior appearance of the main body 100, and the lower body 120 may form a lower exterior appearance of the main body 100. On both sides of a rear portion of the main body 100, wheels 121 may provide to enable the cleaner 10 to clean while moving.

In more detail, the seating portion 150, which may have a cut open or out shape, may be formed on one side of the upper body 110 extending in a lengthwise direction of the main body 100. In other words, the upper body 110 may have a portion extending in the lengthwise direction coupled to the lower body 120 to form a body inside space, and the other portion extending in the lengthwise direction coupled to the lower body 120 to form a body outside space. The body outside space may be a space in which the dust separator 300 and the dust container 200 are positioned. The fan mounting portion 160 may be provided to or in the body inside space, and the dust separator 300 and the dust container 200 may be positioned in, and fastened to, the body outside space, i.e., the seating portion 150.

The main body 100 may have a body handle 111 provided thereto for a user to lift and carry the cleaner 10. The body handle 111 may be provided to or on the upper body 110. The dust container 200 may include a handle 230 to permit the user to couple or decouple the dust container 200 to/from the main body 100 by holding the handle 230. The handle 230 may have a coupling button 231. The coupling button 231 may enable the user to couple or decouple the dust container 200 to/from the body 100 easily by manipulating the coupling button 231 in a state in which the user holds the handle 230. That is, the dust container 200 may be coupled to/decoupled from the body using only one hand.

The dust container 200 may include a case 220, that is, a container to hold the dust. The case 220 may be in communication with the dust separator 300 and may hold the dust separated in the dust separator 300. That is, the case 220 may have a space or region formed therein separate from the dust separator 300 to hold the dust therein.

The case 220 may be formed of a transparent material to make an inside thereof visible from an outside of the case 220. That is, at least a portion of the dust container 200 may be formed of the transparent material to make the inside thereof visible from an outside of the case 220. Due to this, a user may easily determine an amount of dust accumulated in the case 220. The handle 230 may be provided to the case 220 to enable the user to easily couple or decouple the case 220 to/from the body 100.

The dust container 200 may include a cover 210 that opens/closes the case 220. When the cover 210 is closed, an inside of the case 220 may be isolated from the outside of the case 220, to enable the dust to be held therein. When the cover 210 is open, the dust may be discharged from the inside of the case 220 to the outside of the case 220. Therefore, the cover 210 may be detachably provided to the case 220. Thus, the dust container 200 may include the case 220 and the cover 210 that opens/closes the case 220.

As described above, the dust container 200 may be detachably provided to the seating portion 150. That is, the dust container 200 may be detachably provided to or at an outside of the main body 100. The dust container 200 may form an exterior appearance of the cleaner together with the main body 100. Therefore, the cover 210 may form an exterior appearance of the cleaner together with the main body 100.

The cover 210 may have a color or be formed of a material the same as, or similar to, a color or material of the main body 100, more specifically, the upper body 110. Due to this, the cover 210 may be referred to as a body cover 210. The cover 210 may be configured to cover the seating portion 150 in connection to the body 100.

The cover or body cover 210 may be provided to or at a top side of the dust container 200 to form a top side exterior appearance of the cleaner 10 together with main body 100. The case 220 may form a front exterior appearance of the cleaner. Therefore, the dust container 200 having the cover 210 and the case 220 may form an exterior appearance of the cleaner 10 together with the main body 100.

The cover 210 may include a transparent window 212. The transparent window 212 may form a portion of the cover 210. The transparent window may cover an opening 211 formed in the cover 210. The opening 211 may be provided over the dust separator 300. That is, the opening 211 may be formed in a position corresponding to a position of the dust separator 300. An inside of the dust separator 300 may be visible from the outside of the cleaner 10 through the transparent window 212 which covers the opening 211. At least a portion of the dust separator 300 may be formed of a transparent material. Therefore, the inside of the dust separator 300 may be visible from the outside of the cleaner through the transparent window 212. Accordingly, even if the dust container 200 and the dust separator 300 are not separated from the body 100, the user may see the inside of the dust separator 300.

Positions and coupling among the dust container 200, the dust separator 300, and the body 100 will be described in detail hereinbelow with reference to FIGS. 2 and 3.

Figure 2:
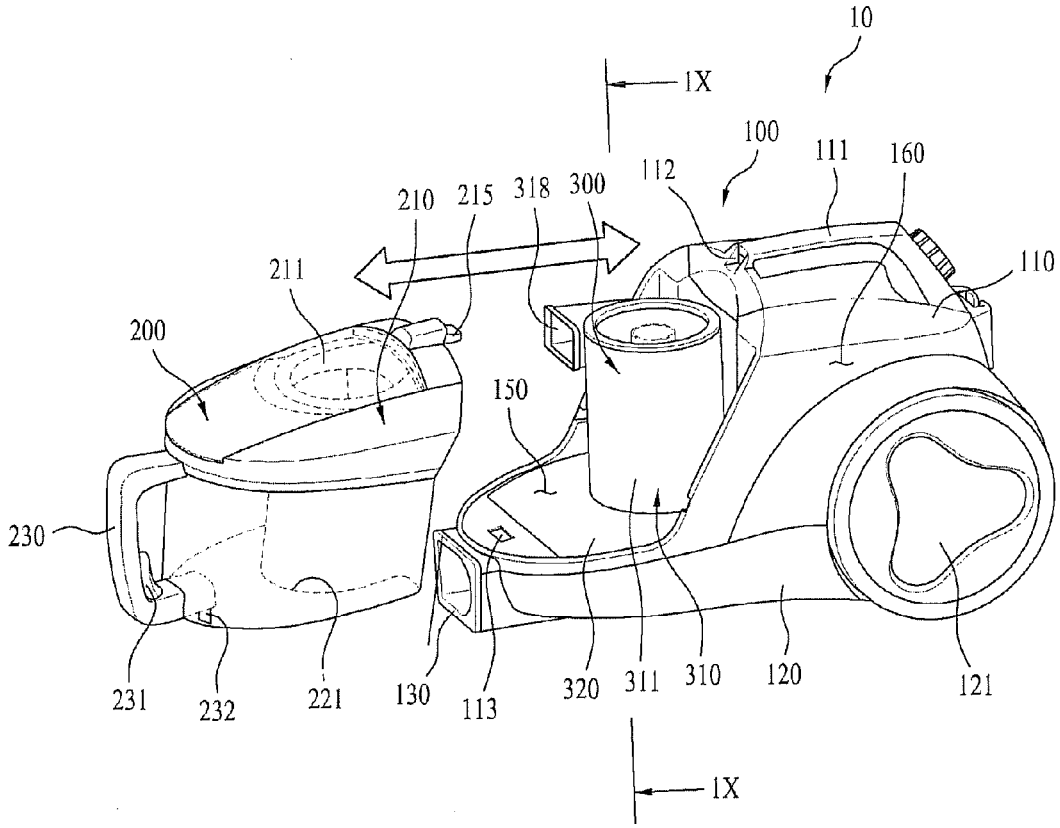
FIG. 2 is a perspective view of the vacuum cleaner of FIG. 1, showing a dust container separated from the vacuum cleaner.

Referring to FIG. 2, the dust container 200 may be mounted to, or provided detachable from, the main body 100. In more detail, the dust container 200 may be detachably provided to the seating portion 150 provided to or on the main body 100. The seating portion 150 may be provided to or at one side of the fan mounting portion 160.

The dust container 200 may be mounted in a substantially horizontal direction with respect to the main body 100. That is, the user may couple or decouple the dust container 200 to/from the main body 100 by moving the dust container 200 in a substantially horizontal direction. This enables the user to mount or dismount the dust container 200 to/from the main body 100 with only one hand. If the dust container 200 is detachable in a substantially vertical direction, the user will be required to use two hands. This is because the user is required to press the main body 100 with one hand and to lift the dust container 200 with the other hand. Thus, the horizontal direction mounting/dismounting of the dust container 200 provides very convenient use of the cleaner 10.

In more detail, the dust container 200 and the dust separator 300 may be separated while the dust container 200 and the dust separator 300 are in communication with each other. In other words, the dust container 200 may be provided to or at an outside of the dust separator 300, and the dust separator 300 may also be provided to or at an outside of the dust container 200. To achieve this, the case 220 of the dust container 200 may have a curved-in portion 221. The curved-in portion 221 may receive the dust separator 300, substantially.

In a state in which the dust container 200 is coupled to the main body 100, the dust separator 300 may be provided between the dust container 200 and the main body 100. That is, the dust separator 300 may be surrounded by the dust container 200 and the main body 100. Accordingly, the dust separator 300 may be secured to the main body 100 by the dust container 200. Also, the dust separator 300 may be provided between the dust container 200 and the body 100, such that the dust separator 300 is not exposed to an outside of the cleaner 10.

A position of the dust separator 300 will be described in more detail hereinbelow.

The dust separator 300 may have a front blocked by the dust container 200, more particularly, the curved-in portion 221 of the case 200. The dust separator 300 may have a bottom blocked by the seating portion 150. The dust separator 300 may have a rear blocked by the seating portion 150, more particularly, a partition wall 151 to be described later. The dust separator 300 may have a top side blocked by the cover 110. With this structure, the dust separator 300 may be secured to the main body 100, more firmly.

The dust separator 300 may be selectively exposed to an outside of the main body 100, depending on whether the dust container 200 is mounted to the main body 100 or not. Therefore, if the user separates the dust container 200 from the main body 100 to empty or clean the dust container 200 only, the user may easily determine a contamination state of the dust separator 300. This is because the dust separator 300 may be exposed to the outside.

Figure 3:
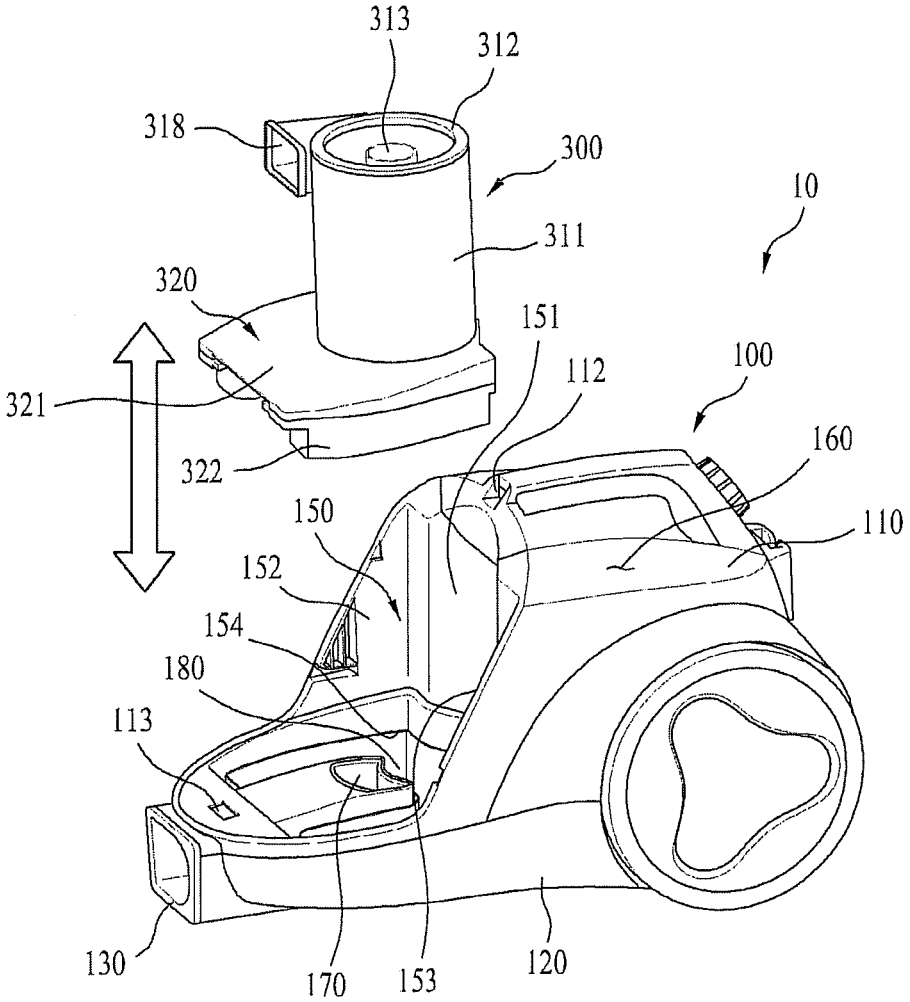
FIG. 3 is a perspective view of the vacuum cleaner of FIG. 1, showing a dust separator separated from the vacuum cleaner.

Referring to FIG. 3, the dust separator 300 may be connected to the main body 100. The dust separator 300 may be mountable to the main body 100 in a substantially vertical direction of the main body 100. That is, a direction of mounting of the dust separator 300 to the main body 100 and a direction of mounting of the dust container 200 to the main body 100 may be different from each other. Further, the directions may be perpendicular to each other.

Such a difference in mountings or couplings may provide a result that the coupling of the dust container 200 to the main body 100 and the mounting of the dust separator 300 to the main body are not related to each other. That is, the coupling or decoupling of the dust container 200 to/from the main body 100 may not influence the dust separator 300, but the dust separator 300 may maintain a connection state to the main body 100 as before. Of course, as will be described later, the dust separator 300 may be secured to the main body 100 firmly due to the coupling of the dust container 200 to the main body 100.

In the meantime, movement of the dust separator 300 in a mounting direction, for example, an upward vertical direction may not be limited. That is, the dust separator 300 may be separated from the main body 100 without any resistance except a weight of the dust separator 300. To do this, the seating portion 150 may have a seating recess or recess portion 154 formed therein to enable the dust separator 300 to be seated therein. Due to this, a holding device that limits movement of the dust separator 300 in a direction in which the dust separator 300 is separated from the body once the dust separator 300 is seated on the seating recess 154, or a releasing device that releases the limiting by the holding device may be omitted.

Referring to FIG. 2, in this embodiment, the dust container 200 may perform a function of securing the dust separator 300 to the main body 100. That is, once the dust container 200 is coupled to the main body 100, the coupling may secure the dust separator 300 to the main body 100. Therefore, once the dust container 200 is coupled to the main body 100, the dust separator 300 may be secured to the main body 100, such that up/down or left/right direction movement of the dust separator 300 may be limited.

As the dust separator 300 is seated on or in the recess or seating recess 154, the dust separator 300 may be preliminarily coupled to the main body 100, and as the dust container 200 is coupled to the main body 100 thereafter, the dust separator 300 may be firmly secured to the main body 100. In more detail, the main body 100 may have devices that secure the dust container 200 after the dust container 200 is mounted to the main body 100. That is, coupling devices or securing devices may be provided to couple or secure the dust container 200. For example, coupling recesses 112 and 113 may be formed, and a coupling projection 215 or a hook or latch 232 in conformity with the coupling recesses 112 and 123, respectively, may be provided. A plurality of recesses may be provided, and positions thereof may vary.

In more detail, the dust container 200 may include the coupling projection 215, and the coupling recess 112 may be formed in the main body 100 corresponding to the coupling projection 215. The coupling projection 215 may be provided to or at an upper side of a rear of the dust container 200. Therefore, the coupling projection 215 may be formed at or on the cover 200. The coupling recess 112 may be formed in the upper body 110 corresponding to the coupling projection 215. In more detail, the coupling recess 112 may be formed in or at an upper side of the seating portion 150.

In such a case, the coupling projection 215 and the coupling recess 112 may form a securing point of the dust container 200 to the main body 100. The securing point may be formed at an upper side of a rear of the dust container 200.

In order to secure the dust container 200 to the main body 100 more firmly, a securing point may also be formed at a lower side of the front of the dust container 200. To do this, the main body 100 may include a coupling recess 113 formed therein. The coupling recess 113 may be formed in the seating portion 150, and, more specifically, in a front portion of the seating portion 150.

The dust container 200 may have the hook or latch 232 provided thereto corresponding to the coupling recess 113. In this case, the latch 232 may be provided to interlock with the coupling button 231. That is, when the dust container 200 is coupled to the main body 100, the latch 232 may be placed in, and secured to, the coupling recess 113, and upon pressing the coupling button 231, the hook or latch 232 may be released, to separate the dust container 200 from the main body 100. The hook or latch 232 may be positioned at a lower side of the front of the dust container 200.

A coupling type between the dust container 200 and the seating portion 150 may vary. Accordingly, it may be said that the seating portion 150 has a coupling portion to couple to the dust container 200, and as an example of which, the coupling recess 113 may be formed.

Due to the above discussed structure, the securing points formed at the front and rear of the dust container 200 and the upper and lower side of the dust container 200 enable the dust container 200 to the main body 100 to be secured more firmly. Due to this, the coupling or decoupling becomes very convenient.

In order to easily couple the dust container 200 to the main body 100, and support a side of the dust container, the seating portion 150 may have a side supporting portion 152 and 153 on each side of the seating portion 150. The side supporting portions 152 and 153 may be formed as one unit with the main body 100, more particularly, with the upper body 110.

When the dust container 200 is coupled to the side supporting portions 152 and 153, as the side supporting portions 152 and 153 guide the dust container 200 in a direction of the coupling, the dust container 200 may be easily coupled to the main body 100. And, by distributing loads which are likely to exert on the securing points, the side supporting portions 152 and 153 enhance durability and effective securing.

The partition wall 151 may be provided between the side supporting portions 152 and 153. That is, the partition wall 151 may be provided as a portion of the seating portion 150. The partition wall 151 may be a portion of the main body 100, more particularly the upper body 110. With reference to the partition wall 151, the dust container 200 and the dust separator 300 may be positioned in or at a front thereof, and the fan mounting portion 160 may be positioned in or at a rear thereof.

The dust container 200, the dust separator 300, and the fan mounting portion 160 may be positioned in the lengthwise direction of the main body 100, in succession. Accordingly, the dust separator 300 may be positioned adjacent to the fan mounting portion 160.

Referring to FIG. 3, the dust separator 300 may include a cyclone device 310. The dust may be separated at or in the cyclone device 310. The dust separator 300 may also include a filter device 320. The filter device 320 may be a device that filters fine dust which is not likely to be separated at or in the cyclone device 310.

The filter device 320 may be provided between the cyclone device 310 and the fan mounting portion 160. That is, the filter device 320 may be provided to prevent fine dust from entering into the fan or the fan drive device 400, to improve durability of the fan or the fan drive device 400, as well as to prevent the fine dust from being discharged outside of the cleaner 10. The cyclone device 310 and the filter device 320 of the dust separator 300 may be fabricated as one assembly.

A separator inlet 170, through which the air may be introduced to the dust separator 300, and a separator outlet 180, through which the air may be discharged from the dust separator 300, may be formed in the seating portion 150. The air having passed through the separator outlet 180 may be introduced to the fan mounting portion 160.

The separator outlet 180 may be provided to discharge the air from the filter device 320. In other words, the air may flow from the cyclone device 310 to the filter device 320, and the air discharged from the filter device 320 may flow to the fan mounting portion 160 through the separator outlet 180.

The filter device 320 may be positioned under the cyclone device 310. As the filter device 320 and the cyclone device 310 may form one assembly to configure the dust separator 300, the user may separate the dust separator 300, including these components, from the main body 100 at one time.

The air having passed through both the body inlet 130 and the separator inlet 170 provided on the lower side of the main body 100, may be introduced to an inside of the cyclone device 310 without passing through the filter device 320. Therefore, shapes of the filter device 320 and the seating portion 150 must be configured to provide a desired flow passage configuration and an upper side/lower side position relationship between the filter device 320 and the seating portion 150.

Figure 4:
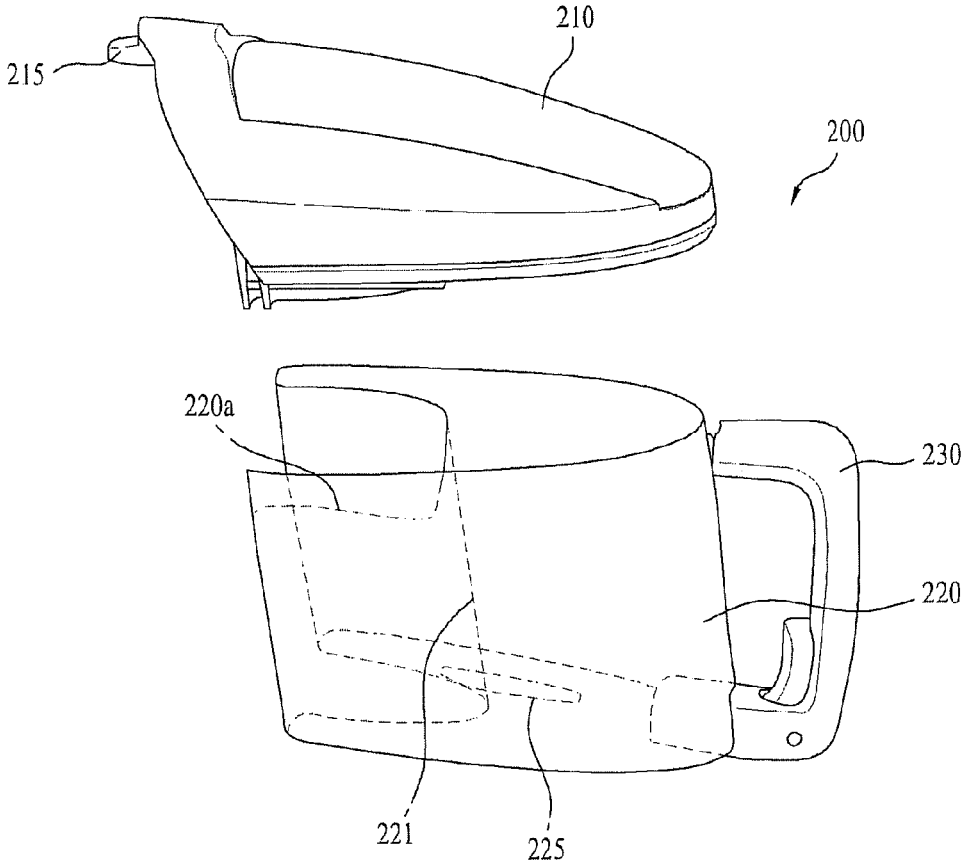
FIG. 4 is an exploded perspective view of the dust container of the vacuum cleaner of FIG. 1.

The dust container 200, the dust separator 300, and a coupling structure between the two will be described in detail, with reference to FIGS. 4 and 5.

The dust container 200 may include the case 220 and the cover 210. As described above, the cover 210 may be a body cover, and the case 220 may be formed in a container shape.

The case 220 may have a bottom formed to extend substantially parallel to the floor. However, alternatively, the bottom may be formed to have a predetermined gradient. For example, the bottom may have an upward gradient in a coupling direction. An angle of an upper side of the filter device 320 of the dust separator 300 may be formed to match the angle of the bottom of the case 220 with respect to the floor. In other words, the upper side of the filter device 320 may also be formed to have a predetermined angle. With this structure, the bottom of the case 220 and the upper side of the filter device 320 may be brought into contact with each other.

The case 200 may have a projection or recess 225 formed at the bottom of the case 220. The projection or recess 225 may be formed to surround a see-through portion 325 of the filter device 320. With this structure, if the dust container 200 is coupled to the main body 100, the projection or recess 225 may press a circumference of the see-through portion 325, preventing the air or the dust from leaking through the see-through portion 325. Of course, the projection or recess 225 may be provided with a sealing member (not shown), or the sealing member (not shown) may be provided to or on a circumference of the see-through portion 325.

If the dust container 200 is separated from the body 100, the see-through portion 325 may be exposed to an outside of the cleaner 10. Therefore, through the see-through portion 325, a contamination level of the inside of the filter device 320 may be easily determined.

The predetermined gradient of the bottom of the case 220, and the upper surface gradient of the filter device 320 may be formed to allow the dust container 200 to be easily coupled or decoupled to/from the main body 100. Moreover, the predetermined gradient, not only has a guiding function when the dust container 200 is coupled, but also enables the dust container 200 to press down the filter device 320. Accordingly, due to the dust container 200, it is made possible to more firmly secure the dust separator 300 including the filter device 320 to the main body 100.

The curved-in portion 221 may be formed in or at a rear of the case 220, that is, in a front of the case 220 with reference to a direction of coupling. Further, the curved-in portion 221 may be formed to surround at least a portion of the dust separator 300.

The curved-in portion 221 may prevent the main body 100 from having to be longer, and increase an inside capacity of the case 200. This is because the curved-in portion 221 increases a space that receives the dust in left/right directions.

Therefore, a lower side shape of the dust container 200, more particularly, the case 220, may be matched to a shape of an upper side shape of the filter device 320, and a rear side shape of the case 220 may be matched to the dust separator 300, more particularly, a cylindrical device 311. Such matched structures provide a more compact cleaner on the whole, and a cleaner for which coupling or decoupling is easy.

The dust separator 300 will be described in detail hereinbelow, with reference to FIGS. 5 to 9.

The dust separator 300 may include the cyclone device 310, which separates the dust from the air using a cyclone principle, and, in addition to this, the filter device 320, which filters fine dust from the air. As shown, the cyclone device 310 and the filter device 320 may be formed as one unit or assembly. Accordingly, the user may separate the dust separator 300 including the cyclone device 310 and the filter device 320 from the main body 100 at one time.

The cyclone device 310 may include the cylindrical device 311 and a conical device 314 in the cylindrical device 311. The cylindrical device 311 forms a space in which the air flows to separate the dust from the air.

The cyclone device 310 may include a dust separator cover 312 on a top of the cylindrical device 311 that opens/closes the cylindrical device 311. The dust separator cover 312 may have a handle 312*a* provided thereto for easy opening/closing of the cover 312. The cover 312 may be hinge coupled to the cylindrical device 312 for easy opening/closing of the cover 312.

The cover 312 may have an extension 313 that extends vertically downward from an inside of the cover 312. The extension 313 may be cylindrical, with an outside diameter formed to match an outside diameter of an uppermost portion of the conical device 314.

The extension 313 may perform a function of smooth formation of a cyclone in the cylindrical device 311, and smooth introduction of the dust separated thus to an inside of the conical device 314. That is, the extension 313 may facilitate smooth discharge of the dust, while the dust whirls on an outside of the extension 313 in a radial direction of the extension 313, and smooth introduction of the air having the dust separated therefrom to the inside of the conical device 314.

The conical device 314 may have a hollow center. That is, the conical device 314 may have a vacant inside. Further, the conical device 314 may have a plurality of slits 314*a* and 314*b* formed therein. The air introduced to the cylindrical device 311 may have the dust separated therefrom, and, thereafter, may be introduced to the filter device 320 after being introduced to an inside of the conical device 314 through the slits 314*a* and 314*b*.

The slits may be formed as lower slits 314*a* and upper slits 314*b*. That is, the conical device 314 may have the lower slits 314*a* formed at a lower portion thereof, and the upper slits 314*b* formed at an upper portion thereof. The lower slits 314*a* may be formed throughout a circumferential direction with lengths longer than the upper slits 314*b*. Alternatively, the upper slits 314*b* may be formed in a portion of the circumferential direction. The upper slits 314*b* may be formed only in a portion opposite to a cyclone inlet 316*b*.

The slits may prevent large dust from discharging from the cylindrical device 311. That is, the slits may have a filter function.

The conical device 314 may have an opening 314*c* formed in a top side thereof. The opening 314*c* may be in a form of a mesh. Therefore, the opening 314*c* may also have a filter function, and may have a function of more smoothly introducing the air to an inside of the conical device 314.

Figure 8:
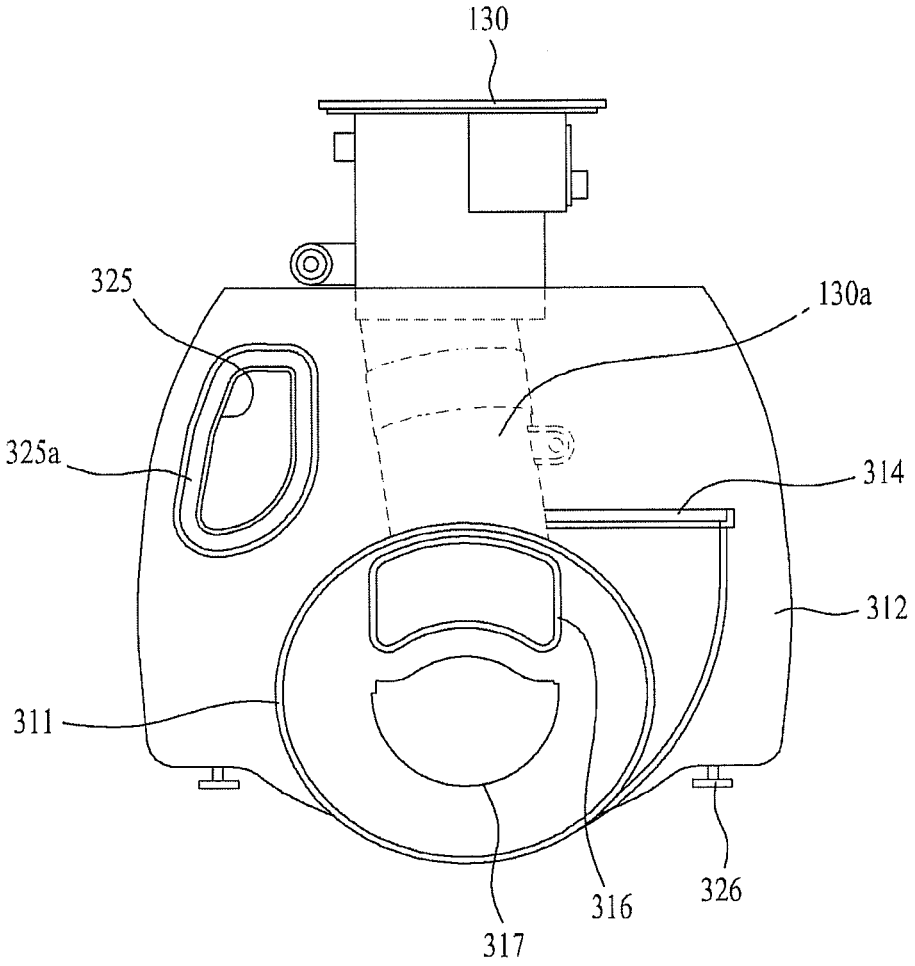
FIG. 8 is a view showing a relation of a suction flow passage to a lower structure of the dust separator of the vacuum cleaner of FIG. 1.

Referring to FIG. 8, the air may be introduced to the dust separator 300 through an air inlet 316 via the body inlet 130 and a suction flow passage 130*a*. The air inlet 316 may be in close contact with the separator inlet 170 shown in FIG. 3. Therefore, the air introduced through the main body 100 may be introduced to the inside of the dust separator 300 through the separator inlet 170 and the air inlet 316. In more detail, the air inlet 316 may be formed in a bottom of the cyclone device 310 in a substantially vertical direction. Therefore, the air may be introduced to the cyclone device 310 from the bottom to an upper side thereof vertically.

Figure 9:
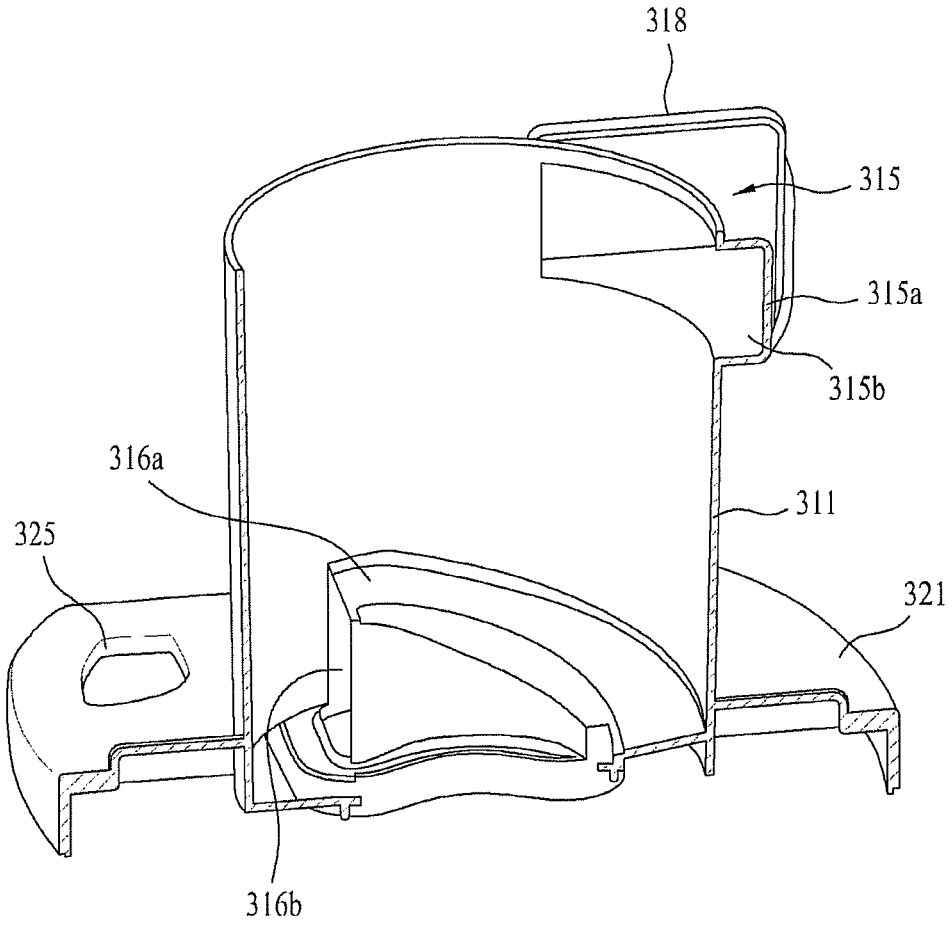
FIG. 9 is a sectional view of the dust container of the vacuum cleaner of FIG. 1, taken along line IX-IX of FIG. 2.

However, in order to produce the cyclone, it is required that the air may be made to flow in a whirl. For this, as shown in FIG. 9, the cylindrical device 311 may have a guide portion 316*a* formed thereon that guides the air introduced through the air inlet 316 in an upward tangential direction. That is, the guide portion 316*a* may be formed to guide suctioned air introduced through the air inlet 316.

The guide portion 316*a* may be formed upwardly in a circumferential direction of an inside of the cylindrical device 311. With this structure, the suction air may be guided to move up along an inside circumferential of the cylindrical device 311 in a helix by the guide portion 316*a*. The air guided thus may be discharged to an inside of the cylindrical device 311 through the cyclone inlet 316*b*, to make a consistent whirling and moving up of flow thereafter. This consistent whirling and flowing up enables the dust to be separated from the air.

The guide portion 316*a* may also have a function of guiding the air already discharged through the cyclone inlet 316*b* to whirl and flow up again. This is because the guide portion 316*a* has an outside shape formed to match to an inside shape of the guide portion 316*a*. With this structure, the air whirling on an outside of the guide portion 316*a* also moves up along the outside of the guide portion 316*a*.

The dust separated at the cyclone device 310 may move along a dust discharge guide or dust discharge flow passage 315 and be introduced to the dust container 200 through a dust outlet 318.

Referring to FIG. 8, the cyclone device 310 may have an air outlet 317 in a bottom of a center of the cyclone device 310 to discharge the air. The air outlet 317 may be formed in a bottom of a center of the conical device 314. That is, the air having the dust separated therefrom by the cyclone flow in the cylindrical device 311 may escape the cylindrical device 311 through the air outlet 317 and may be introduced to the filter device 320. The filter device 320 may have an air inlet through which the air is introduced from through the air outlet 317.

However, as described later, the cyclone device 310 and the filter device 320 may be fabricated as one assembly. In particular, the cylindrical device 311 and an upper side of the filter device 320, for example, a portion of a filter case to be described later, may be formed as one unit. In this case, the air outlet 317 itself may be the air inlet.

Referring to FIG. 9, the dust discharge guide or dust discharge flow passage 315 may be provided so that the dust may be smoothly discharged from the dust separator 300 to the dust container 200. That is, the dust discharge guide 315 may be provided to or at an outside of the dust separator 300. Therefore, the dust discharge guide 315 may be formed at a position spaced at a maximum from an axis of the dust separator 300. The air moves up while whirling in a helix within the cyclone device 310. The dust in the air tends to move away from the axis of the cyclone device 310 gradually as a centrifugal force thereof becomes stronger during to a mass of the dust and to escape the cyclone device 310 in a tangential direction. Accordingly, the dust discharge guide or dust discharge flow passage 315 may be formed at the upper side of the cyclone device 310 in the tangential direction thereof.

The dust discharge flow passage 315 may include an enlarged portion 315*a* on an outside of the cylindrical device 311. That is, the dust discharge flow passage 315 may include an enlarged portion 315*a* that extends in the tangential direction. The dust discharge flow passage 315 may further include a straight portion 315*b*, to secure a wider straight flow passage, to guide a large amount of the dust along the dust discharge flow passage 315 in a straight line, permitting discharge more smoothly of the dust to the dust container 200.

The dust discharge flow passage 315 may include the dust discharge outlet 318 formed at an end thereof. That is, the dust discharged from the dust discharge outlet 318 may be discharged to the dust container 200. The container 200 may have a dust inlet 220*a* provided thereto matched to the dust discharge outlet 318. The dust inlet 220*a* may be provided lower than the dust discharge portion 318. The dust inlet 220*a* may not be required to have a particular shape, but may be formed slightly lower than other portions of the rear (opposite side of the handle) of the case 220. The dust discharge portion 318 may project to an inside of the case 220 through this portion. That is, as the dust container 200 is slidably mounted, the dust discharge portion 318 may be introduced to the inside of the case 220, and in an opposite case, the dust discharge portion 318 may be withdrawn from the case 220. Due to such structure, the dust may be prevented from flowing in a reverse direction from the dust container 200 through the dust discharge portion 318.

The dust discharge portion 318 may face the dust container 200, that is, the front of the main body 100. In other words, the dust may be introduced to the dust container 200 in a direction opposite to a direction of the air being introduced to the inside of the main body 100. This implies that the dust separator 300 may have a center formed on a straight line of a center of the dust container 200 in the rear of the dust container 200. With this structure, flow resistance may be reduced and a more compact dust container 200 and dust separator 300 may be formed.

Figure 6:
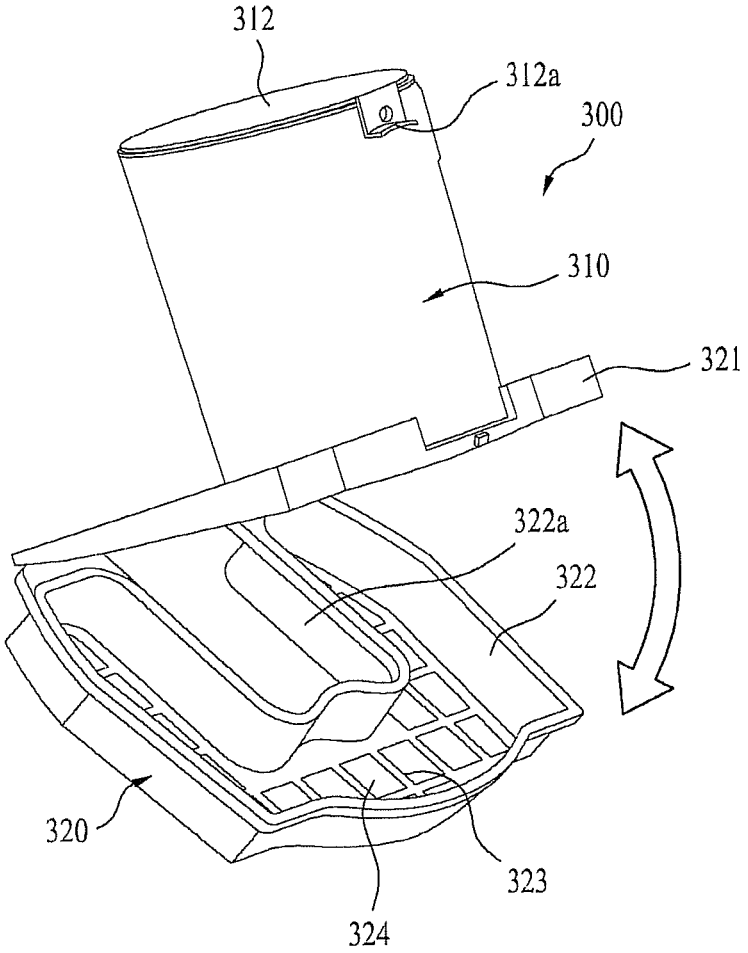
FIG. 6 is a perspective view of a filter of the vacuum cleaner of FIG. 1, in an opened state.
Figure 7:
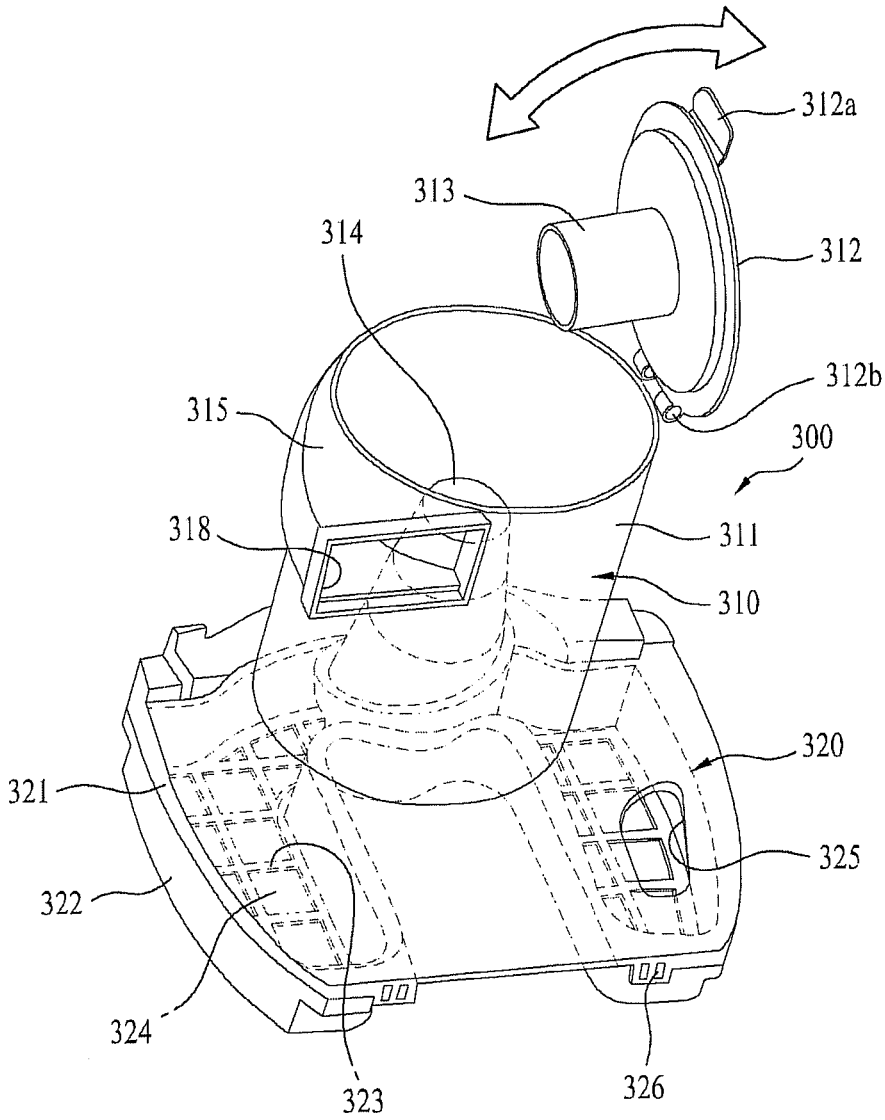
FIG. 7 is a perspective view of the dust container of the vacuum cleaner of FIG. 1, with a cover opened.

Referring to FIGS. 6 and 7, the filter device 320 may include a filter frame 321 and 322, and a filter (not shown) mounted in the filter frame 321 and 322. The filter may be a sponge type filter, with a shape in conformity with an inside shape of the filter frame 321 and 322, enabling the filter to be mounted in the filter frame 321 and 322 in close contact therewith, to filter fine dust with the filter.

The filter frame may be opened/closed to clean the filter in the filter frame 321 and 322, and to empty the fine dust filtered thus and held in the filter frame 321 and 322. For this, the filter frame 321 and 322 may include an upper frame 321 and a lower frame 322. The lower frame 322 may be provided to detachably couple to the upper frame 321, or to be opened/closed using a structure, such as a hinge 326. With this structure, the coupling of the upper frame 321 and the lower frame 322 may form a space configured to receive the filter therein.

Positions of the frames 321 and 322 may vary with a mounting position or shape of the filter device 320. Therefore, the filter device 320 may include the first frame 321 and the second frame 322.

The first frame 321 may have the air inlet formed therein to introduce the air discharged from the air separator 200, more particularly, the cylindrical device 311 of the cyclone device 310. However, the air inlet may be the air outlet 317 in the air separator 200 itself.

The second frame 322 may be coupled to the first frame to form an inside space. The second frame 322 may be in communication with the fan mounting portion 160.

Referring to FIGS. 6 and 7, the lower frame or the second frame 322 may extend in left/right directions along the separator outlet 180. After extending in the left/right directions, the lower frame or the second frame 322 may extend again further toward the front of the main body 100, that is, the dust container 200. With this structure, the lower frame or the second frame 322 may be formed in a 'ㄷ' shape. That is, a frame curved-in portion 322*a* may be formed in a center portion of the lower frame 322, enabling the air to be discharged through a large filter area from the filter device 320, thereby enabling enhanced efficiency.

The recess portion 154 (see FIG. 3) formed in the seating portion 150 corresponding to a shape of the lower frame 322 may enable the cyclone device 310 to be securely fastened together with the filter device 320.

Moreover, due to the shape of the lower frame 322, that is, due to the frame curved-in portion 322*a*, the air may be introduced to the cyclone device 310 directly through the center portion of the lower frame 322 without passing through the filter device 320. This is because the separator inlet 170 (see FIG. 3) may be positioned to match a position of the frame curved-in portion 322*a* of the lower frame 322.

The upper frame 321 may cover the lower frame 322, and the separator inlet 170 may be in communication with the cyclone device 310 in close contact thereto. Therefore, the upper frame 321 may have a shape not matched to the frame curved-in portion 322*a*. That is, the upper frame 321 may be formed to cover both the lower frame 322 and the frame curved-in portion 322*a*.

The lower frame 322 may have openings 323, which may be in a grating form, formed therein, with a mesh type filter 324 having very fine holes provided thereto. Therefore, the air being introduced to the filter frame 322 may have the fine dust filtered two times by the sponge type filter and the mesh type filter 323. The fine dust filtered thus may be held in the filter device 320. The air having the fine dust filtered may thus escape from the filter device 320 passing through the filter and so on. In more detail, the air may pass through the filter device 320, that is, through the mesh type filter formed in the openings 323. The air having passed through the filter device 320 thus may be introduced to the fan mounting portion 160 through the separator outlet 180.

It is not necessary that the filter frames 321 and 322 be configured of the upper and lower frames. That is, the filter frames 321 and 322 may be left/right frames. However, in any case, the filter frames 321 and 322 may be separated or opened to clean an inside space.

In the meantime, the filter frame 321 and 322 may be formed of a transparent material. Of course, the filter frame 321 and 322 may be formed of a non-transparent material, or a portion thereof may be formed of the transparent material. If fine dust is accumulated in the filter device 320, it is necessary to clean the fine dust. Therefore, it is necessary that the user is able to know whether or not fine dust has accumulated in the filter device 320 without opening the filter frame.

For this, the filter device 320 may have the see-through portion or opening 325 provided therein. The see-through portion or opening 325 may be a cut-out of a portion of the filter frame. The dust or air may leak to an outside of the cleaner through the see-through portion or opening 325. To prevent this, a structure that blocks the see-through portion or opening 325 may be required. The structure that blocks the see-through portion or opening 325 matched to the structure of the see-through portion or opening 325 may be provided to the dust container 200.

Referring to FIG. 7, the see-through portion 325 may be formed at or in the upper frame 321. The dust container 200, more specifically, the case 220, may be positioned on the upper frame 321. Therefore, a structure may be formed on a bottom of the case 220 that tightly closes the see-through portion 325.

Figure 5:
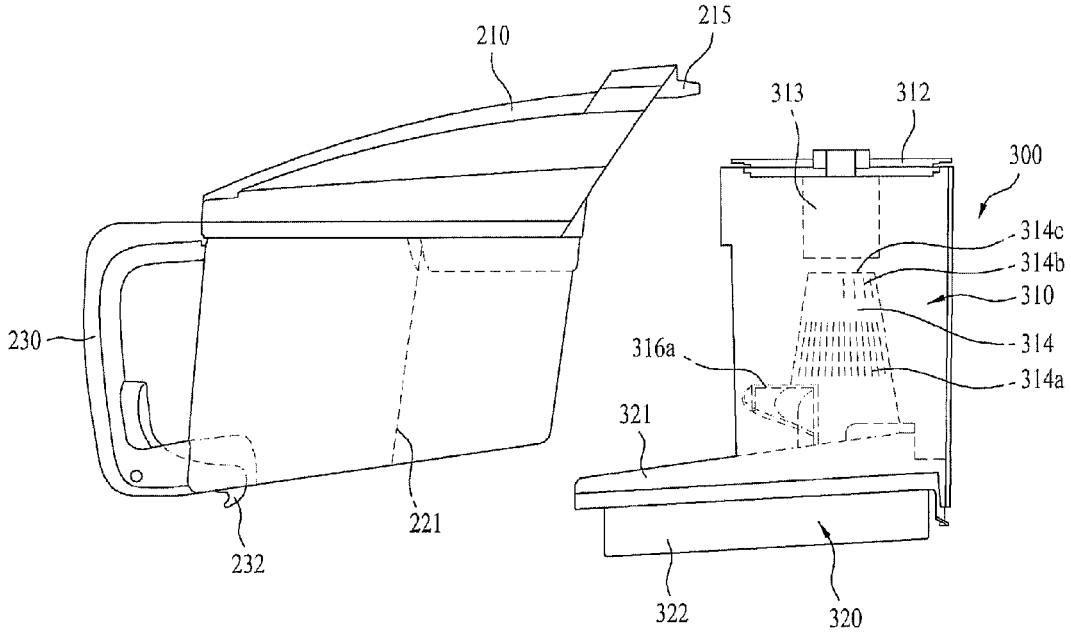
FIG. 5 is a front view of a coupling structure of the dust container and the dust separator of the vacuum cleaner of FIG. 1.

Referring to FIG. 5, the upper frame 321 and the bottom of the case 220 may be provided to be in surface-to-surface contact with each other. The dust container 200 may couple to the main body 100 while the bottom of the case 220 slides on the upper frame 321. With such a coupling, the bottom of the case 220 may press down the see-through portion or opening 325 to block the see-through portion or opening 325. Therefore, if the dust container 200 is separated from the body 100, the inside of the filter device 320 may be exposed to an outside of the cleaner 10 through the see-through portion or opening 325.

The user can easily determine a contamination level in the inside of the filter device 320 through the see-through portion or opening 325. That is, even if the dust separator 300, more specifically, the filter device 320, is not opened, or separated, the contamination level of the filter device 320 may be easily determined, which is very convenient.

Referring to FIG. 9, the upper frame 321 may form a bottom of the cyclone device 310. Therefore, the air may be introduced to the cyclone device 310 without passing through the filter device 320, and the air may be introduced to the filter device 320 from the cyclone device 310.

The cylindrical device 311 of the cyclone device 310 and the upper frame 312 of the filter device 320 may be formed as a unitary body. Therefore, fabrication of the dust separator 300 may be easy, and assembly and productivity improved.

The cylindrical device 311 may have an inside diameter that increases as the cylindrical device 311 extends upward. That is, the cylindrical device 311 may be formed in a shape in which the cylindrical device 311 expands in a radial direction as the cylindrical device 311 extends upward. This enables easy placing in, and drawing out of a mold, making the cylindrical device 311 easy to be formed as one body by molding.

The cylindrical device 311 may be elliptical. That is, the cyclone device 310 may include a (a*b) cylinder, a left/right direction width 'a' of which may be larger than a front/rear direction width 'b' thereof. Further, the dust discharge flow passage 315 may be formed at a left side or a right side, that is, a side which is farthest from the axis. By making the cyclone device 310 discharge the dust from the farthest spot from the axis according to the cyclone principle, dust separation efficiency may be increased.

As described above, the cylindrical device 311 may be formed of the transparent material to allow the inside of the cyclone device 310 to be easily viewed. Therefore, since the cylindrical device 311 and the upper frame 321 may be formed as one body, at least the upper frame 321 may be formed of the same material, that is, the transparent material.

The filter device 320 may be a device that filters fine dust. Therefore, the filter device 320 may hold the fine dust therein. As the dust is very fine, the filter device 320 may become foggy, even if only a small amount of fine dust is introduced into the filter device 320, making it difficult to ascertain a contamination level inside of the filter device 320, more specifically, a contamination level of the filter in the sponge form in the filter device 320. That is, even if at least a portion of the filter device 320 is formed of the transparent material, a problem that the filter device 320 becomes non-transparent may take place in view of the nature of fine dust. In order to solve the problem, as described before, the see-through portion or opening 325 may be formed.

Figure 10:
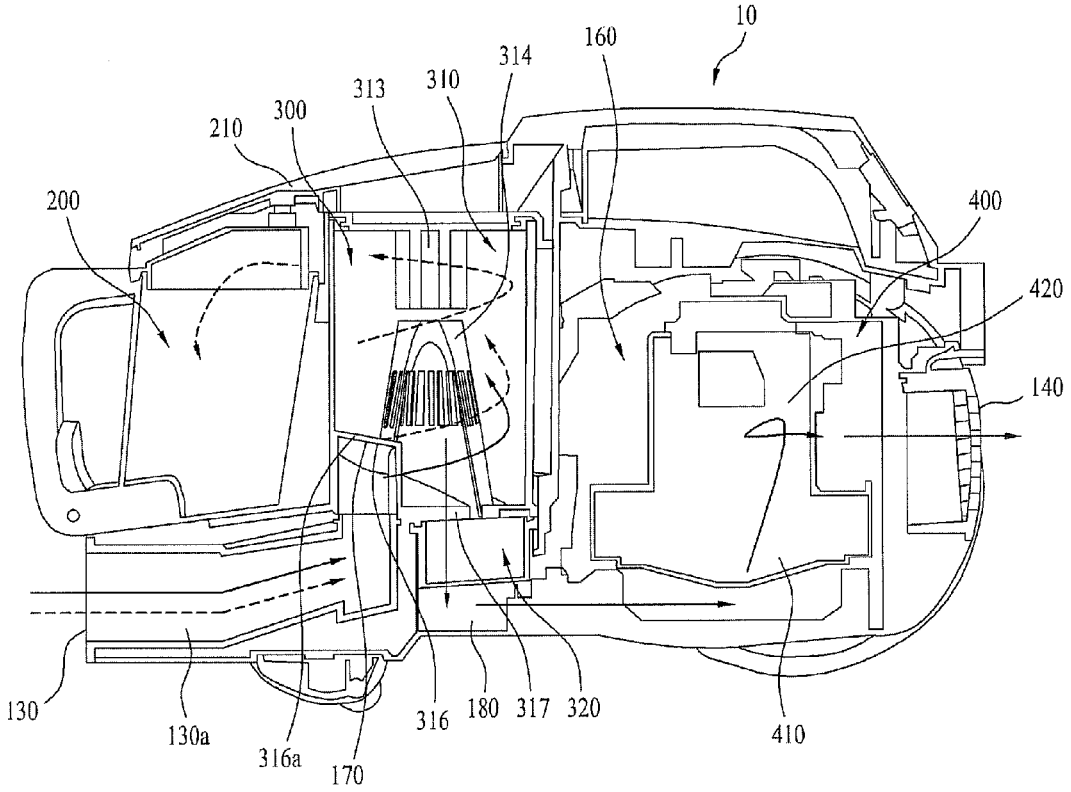
FIG. 10 is a sectional view showing flow directions of air and dust in the vacuum cleaner of FIG. 1, taken along line X-X of FIG. 1.

An air flow structure of the cleaner in accordance with an embodiment will be described in detail with reference to FIG. 10. In FIG. 10, solid arrow marks denote air flow directions, respectively, and dashed arrow marks denote dust flow directions, respectively.

The air and the dust may be introduced to the dust separator 300 through the body inlet 130 formed in the front of the body 100 and the suction flow passage 130*a* in the body in communication with the body inlet 130. In more detail, the air and the dust may be introduced to the inside of the dust separator 300 through the suction flow passage 130*a*, the separator inlet 170, and the air inlet 316 in the dust separator 300. The air having the dust separated therefrom in the dust separator 300 may be discharged through the air outlet 317 formed at a center portion of the dust separator 300.

Referring to FIG. 8, centers of the body inlet 130, the separator inlet 170, the air inlet 316 and the air outlet 317 may be on a substantially straight line. That is, a flow direction of the air may be positioned on a plane. According to this, by minimizing left/right direction bent portions, a more smooth air flow may be produced, to maximize efficiency.

The suction flow passage 130*a* between the body inlet 130 and the separator inlet 170 may also have a straight line shape in a lengthwise direction. The suction flow passage 130*a* may be formed parallel to the floor. Alternatively, only a section of the suction flow passage 130*a*, for example, a front section thereof, may be formed parallel to the floor.

Referring to FIG. 8, taking an arrangement in relation to different elements in the body into account, the suction flow passage 130*a* may be formed in an oblique line shape on a plane. However, even such a suction flow passage 130*a* also has the substantially straight line shape on a plane.

The air discharged through the air outlet 317 may be introduced to, and escape from, the filter device 320 vertically, and may be introduced to the separator outlet 180. In this course, the fine dust is filtered from the air once again.

The air may be guided from the separator outlet 180 to a rear side of the body 100 in the lengthwise direction thereof. That is, the air may be introduced to the fan mounting portion 160 provided in the rear of the dust separator 300. A flow passage between the dust separator 300 and the fan mounting portion 160 may also be formed in the straight line shape in the lengthwise direction. A flow passage between the fan mounting portion 160 and the body outlet 140 may also be formed in the straight line shape in the lengthwise direction.

The air may flow in the straight line shape on a plane starting from introduction of the air to the inside of the body to discharge of the air out of the body. That is, the air may flow in the lengthwise direction of the body from the front to the rear of the body, preventing the air from flowing from the rear to the front of the body, starting from the introduction of the air to the inside of the body to discharge of the air out of the body, except for the whirling flow in the cyclone unit 310.

For this, the air inlet 316 in the dust separator 300 may be positioned in front of the air outlet 317, and centers of above the two positioned on the same axis in the lengthwise direction of the body. The centers of the air inlet 316 and the air outlet 317 may be positioned on the same axis with centers of the fan mounting portion 160 and the body outlet 140.

Moreover, with embodiments disclosed herein, the body inlet 130, the air inlet 316 of the dust separator 300, the air outlet 317 of the dust separator 300, the fan mounting portion 160, and the body outlet 140 may be arranged in the lengthwise direction of the body 100, in succession. Axes of these elements may form a same vertical plane. In other words, centers of these elements may form a same substantial straight line on a same plane.

The air flow may have no variation in left/right directions, as well as in up/down directions. In other words, the air flow may have a shortest path in the lengthwise direction of the body 100, as well as in a heightwise direction of the body.

Thus, the body inlet 130 and the body outlet 140 may be provided on a lower side of the body 100.

Of course, a vertical direction air flow may be produced to separate the dust in the dust separator 300. However, since such a vertical direction length is a length for separating the dust, excessive reduction of the length has a limitation. Accordingly, a vertical direction air flow path length in the body 100 may be minimized, rather than reducing the vertical direction air flow path length in the dust separator 300.

Embodiments disclosed herein position the fan driving device 400 at a position exactly opposite to a related art position thereof to reduce a vertical direction air flow path in the fan mounting portion 160. That is, the fan 410 may be positioned on a lower side, and the motor 420, which drives the fan 410, may be positioned on an upper side of the fan 410. The fan 410 may be an axial flow fan.

Accordingly, different from the related art, by mounting the fan driving device 400 including the fan 410 and the motor 420 in an upside down position, the vertical direction air flow path may be minimized.

For an example, if a vertical position of the fan driving device 400 shown in FIG. 10 is inverted, the air introduced to the fan driving device 400 through the separator outlet 180 rises to an uppermost position of the fan driving device 400. Then, the air moves down through an axis of the fan driving device 400 again, and is discharged from the body outlet 140. Therefore, an air flow path corresponding to a height difference between the separator outlet 180 and the fan driving device 400 may be produced to cause higher flow path resistance.

Opposite to this, since the embodiment is able to make heights of the separator outlet 180 and the lower side (a position at which the air is introduced) of the fan 410 or the fan driving device 400 substantially the same, the vertical air flow passage in the body 100 may be minimized. The air discharged from the bottom of the dust separator 300 may be introduced to the fan mounting portion, horizontally.

Different from the related art, in embodiments disclosed herein, the air inlet to the fan driving device 400, for example, an air inlet to the axial flow fan may be mounted to face the floor.

In embodiments disclosed herein, the dust separator 300 may include the filter device 320. The air being discharged from the cyclone device 310 may be introduced to the filter device 320 vertically without changing a flow direction. That is, to pass through the filter, the flow direction does not change. Consequently, more effective filtering may be made, and flow resistance required for the filtering may be reduced. Along with this, by reducing the air flow resistance, noise may be reduced.

The dust introduced to the inside of the dust separator 300 may be discharged from the upper side of the dust separator 300 according to a nature of the dust in which a whirling direction thereof becomes larger as the dust rises more, and more specifically, in a tangential direction from the upper side of the dust separator 300.

The tangential line may be formed in or at a more expanded shape in an outer side of a radial direction. The tangential line may form the dust discharge flow passage 315, and the dust discharge flow passage 315 may discharge the dust in the frontward direction of the main body 100.

Accordingly, the dust may be discharged in a direction opposite to a direction of air flow through the dust discharge flow passage 315 except the inside of the dust separator 300. That is, the dust may be introduced from the dust separator 300 to the dust container 200 in the frontward direction and the tangential direction of the dust separator 300.

As discussed above, embodiments disclosed herein are directed to a vacuum cleaner. Embodiments disclosed herein provide a vacuum cleaner which may solve problems of related art vacuum cleaner.

Embodiments disclosed herein provide a vacuum cleaner that enables easy separation of the dust container from the cleaner and easy cleaning of the same. Embodiments disclosed herein further provide a vacuum cleaner having a dust container which is light and easy to fabricate for convenient use of the vacuum cleaner.

Embodiments disclosed herein further provide a vacuum cleaner having a dust container and a dust separator (a cyclone unit or device) provided individually that reduce an effort required of the user due to unnecessary cleaning by taking into account a difference in frequencies of cleaning between the dust container and the dust separator. Embodiments disclosed herein also provide a vacuum cleaner in which a horizontal flow distance and a vertical flow distance, through which air and dust flow, may be reduced to reduce flow resistance, thereby enhancing efficiency and reducing noise.

Embodiments disclosed herein also provide a vacuum cleaner in which a cyclone unit or device and a filter unit or device may be configured as a single assembly to facilitate coupling of the cyclone unit and the filter unit to, and separating from, the cleaner easy for convenient use of the vacuum cleaner. Embodiments disclosed herein also provide a vacuum cleaner that enables easy hold of a contamination level of the cyclone unit in the vacuum cleaner, as well as not to separate the cyclone unit from the cleaner, but to expose the cyclone unit to an outside of the cleaner even if the dust container is separated from the cleaner. With this structure, unnecessary cleaning of the cyclone unit and/or the filter unit is not required.

Embodiments disclosed herein also provide a very simple dust container, and a vacuum cleaner, which is convenient to use, in which the dust container has a very simple inside shape, such that dust may be discharged by only turning the case upside down. Embodiments disclosed herein further provide a vacuum cleaner that enables easy hold or determination of a contamination of a filter in a filter unit or device.

Embodiments disclosed herein also provide a vacuum cleaner, in which a dust separator and a dust container may be configured individually, such that the dust separator may be secured to the cleaner firmly with the dust container to make the vacuum cleaner easy to use.

Embodiments disclosed herein additionally provide a vacuum cleaner that may include a body including a fan mounting portion configured to receive a fan mounted thereto, a dust separator provided to one side of the fan mounting portion that draws air by a suction force of the fan to separate dust from the air by a cyclone principle, and a dust container provided to or at an outside of the dust separator to be separable from the dust separator, that holds the dust separated at the dust separator.

The dust container and the dust separator may be mounted in directions different from each other with respect to the body. That is, a direction of mounting of the dust separator may be different from a direction of mounting of the dust container.

The dust container may be mounted to the body in a horizontal direction, substantially. The dust separator may be mounted to the body in a vertical direction, substantially. Therefore, the direction of mounting of the dust container to the body (or a direction of decoupling from the body) and the direction of mounting of the dust separator to the body (or a direction of decoupling from the body) may cross with each other. The dust separator may be positioned adjacent to the fan mounting portion, and the dust container may have a curved-in portion to position the dust separator therein. The dust separator may be mounted vertically, and may have a bottom with an air inlet provided therein, and an upper side with a dust discharge portion provided thereto to discharge the dust separated from the air thus. The dust container may have an upper side with a dust inlet provided thereto matched to the dust discharge portion in the dust separator.

The vacuum cleaner may further include a detachable body cover provided to or at top sides of the dust separator and the dust container. The body cover may have a function of covering the dust container. The body cover, which may be positioned on top sides of, not only the dust container, but also the dust separator, may form an exterior appearance of the body. Therefore, the dust container cover may be referred to as a body cover. The dust separator may have a top side provided with a detachable dust separator cover. Accordingly, the dust separator and the dust container may be opened/closed individually with the individual dust separator cover and the body cover (the dust container cover).

The vacuum cleaner may further include a seating portion provided to one side of the fan mounting portion. The dust separator and the dust container may be mounted to the seating portion. The seating portion may be provided extended from a lower side of the fan mounting portion.

The seating portion may have a suction flow passage provided thereto to be in communication with the dust separator. Further, the seating portion may have a recess portion in a shape in conformity with a bottom shape of the dust separator. As a portion of the dust separator is placed in the recess portion, preliminary coupling of the dust separator to the body may be made.

The vacuum cleaner may further include a filter unit or device provided under the dust separator that filters fine dust from the air discharged from the dust separator. The dust separator may be formed together with the filter unit or the dust separator, or the filter unit may be formed, individually.

The filter unit may include a filter frame, and a filter mounted in the filter frame. The filter frame may be opened/closed. A sponge type filter may be provided in the filter frame, that filters fine dust.

The filter frame may include an upper frame coupled to the dust separator, and a lower frame detachably coupled to the upper frame. However, positions between the frames may vary, such as a left side/right side position, besides the upside/lower side position. The filter frame may include a first frame and a second frame, which couple to each other to form an inside space.

The first frame may have an air inlet in communication with the air outlet in the dust separator, and the second frame may be in communication with the first frame and in communication with the fan mounting portion. The second frame may be formed extended in left/right directions according to the separator outlet. The filter frame may have a see-through portion provided thereto that makes an inside of the filter frame visible without opening the filter frame.

The dust separator may have a dust discharge guide provided to or at an upper side of the dust separator in communication with the dust container. The dust discharge guide may be provided to or at an outside of the dust separator, for example, in a tangential direction of the dust separator.

The dust container may be seated on an upper side of the filter unit. Therefore, a bottom of the dust container may be in surface to surface contact to or with the upper side of the filter unit. With this structure, the dust container may couple to or decouple from the body, while the bottom of the dust container may slide on the upper side of the filter unit. Due to such surface to surface contact, the dust container may press down the dust separator, securing the dust container to the body more firmly to prevent the air or the dust from leaking. For easy detachment from or attachment to the upper side of the filter unit, the bottom of the dust container and the upper side of the filter unit may have predetermined gradients formed thereon.

The filter unit may have an opening to see the filter, and the opening may be sealed by the dust container.

The seating portion may have a coupling portion to couple to the dust container.

The fan mounting portion may have an axial flow fan provided thereto, with an air inlet of the axial flow fan faced to a floor. Due to such a mounting position of the axial flow fan or the fan driving unit or device, a vertical direction air flow may be minimized.

The dust separator may include a cylindrical unit or device mounted vertically, and a conical unit or device mounted in the cylindrical unit. The cylindrical unit may include a bottom provided with an air inlet, and an upper side provided with a dust discharging portion.

The air inlet may have a guide portion that guides suction air. The guide portion may guide the air being introduced to the guide portion to rise in a circumferential direction. The guide portion may also guide the air introduced thereto already to rise in the circumferential direction.

The conical unit may have upper side openings in an upper side thereof, and a hollow portion at a center thereof. That is, the conical unit may be vacant.

The upper side openings may include a plurality of slits, which may have lengths different from each other. That is, the slits provided on a lower side of the conical unit may have vertical lengths longer than the slits provided on an upper side of the conical unit.

The cylindrical unit may be a rectangular (a×b) cylindrical shape, with an outside diameter which becomes larger or increases as the cylindrical unit extends to an upper side. That is, the cylindrical unit may be formed to diverge as the cylindrical unit extends to an upper side.

The dust separator and a portion of the dust container may be formed of a transparent material that makes insides thereof visible, respectively. The dust separator may be formed to include, not only the cyclone unit, but also the filter unit. The cylindrical unit of the cyclone unit and the filter unit may be formed as a unitary body. That is, the cylindrical unit of the cyclone unit and the filter unit may be formed of the same material as a unitary body by one molding process.

The vacuum cleaner may be of a canister type.

Embodiments disclosed herein provide a vacuum cleaner that may include a body including a fan mounting portion to mount a fan thereto, a dust separator provided to one side of the fan mounting portion in communication with the fan mounting portion, and a dust container having a curved-in portion to receive the dust separator therein. The dust container may be provided to or at an outside of the dust separator separable from the dust separator. The dust separator and one side of the dust container may be arranged adjacent to a partition wall of the fan mounting portion.

The vacuum cleaner may further include a seating portion formed extended from a lower part of the fan mounting portion and from one side of the fan mounting portion, and the dust separator and the dust container may be mounted to the seating portion. The seating portion may be formed on an outside of the body.

Therefore, the fan mounting portion may be a predetermined space provided in the body, and the seating portion may be a predetermined space provided to or at the outside of the body. The seating portion may have a separator inlet and a separator outlet both in communication with the dust separator.

The dust container may be detachable from the body independent from the dust separator. That is, the two may be coupled to or decoupled from the body, individually.

The dust container may have a detachable body cover provided to or at one side of the fan mounting portion to open/close the dust container. The dust separator may have a detachable dust separator cover independent from the body cover. With this structure, the dust container and the dust separator have individual spaces independent from each other and in communication with each other. That is, a space that holds the dust and a space that separates the dust may be spaces independent from each other. Accordingly, the space that holds the dust is provided to or at an outside of the space to separate the dust, and the space that separates the dust is also provided to or at an outside of the space to hold the dust.

Embodiments disclosed herein provide a vacuum cleaner that may include a body having a suction flow passage and a fan mounting portion to mount a fan driving unit or device thereto, a dust separator having a bottom in communication with the suction flow passage and in communication with the fan mounting portion, and a dust container having an upper side with a dust discharge portion in communication with the dust separator. The dust discharge portion may include a dust discharge flow passage formed to discharge the dust in a tangential direction of the dust separator. The dust separator may have a portion of a bottom in communication with the suction flow passage and another portion of the bottom in communication with the fan mounting portion.

The body may include a body inlet in communication with the suction flow passage to introduce air to an inside of the body, and a body outlet in communication with the fan mounting portion to discharge the air to an outside of the body. The body inlet and the body outlet may be on a same line with a central or central longitudinal axis of the body in a length or lengthwise direction of the body. That is, the body inlet and the body outlet may be provided on the same axis, to form a straight line on a plane, substantially. The air may be introduced through the suction flow passage from outside of the body, horizontally. In this case, the horizontal may be parallel to ground or a floor.

The air and the dust may be separated from each other as the air flows upward in the dust separator. The air having the dust separated therefrom may be discharged downward vertically, and the dust separated thus in the dust separator may be discharged from an upper side of the dust separator, horizontally. The air discharged from the bottom of the dust separator may be introduced to the fan mounting portion horizontally, and the air introduced to the fan mounting portion horizontally may be introduced to the fan driving unit upward vertically, and discharged from the fan driving unit, horizontally.

The dust separator may include a cylindrical unit or device mounted vertically, and a conical unit or device mounted in the cylindrical unit. The cylindrical unit may have a bottom with an air inlet and an air outlet provided thereto. The air inlet may be provided in a front of the dust separator, and the air outlet may be provided in a center of the dust separator.

The body inlet, the air inlet, the air outlet, the fan mounting portion, and the body outlet may be provided in succession in the length direction of the body. The body inlet, the air inlet, the air outlet, and the fan mounting portion may have centers which form the same plane. That is, the centers may form a plane in a vertical direction. In other words, the centers may form a straight line on a plane.

The dust discharge portion may be provided to discharge the dust in a front or frontward direction of the body. That is, the dust may be discharged in a direction opposite to a direction of introduction of the air to the body.

The dust separator and the dust container may be mounted to or on a seating portion provided to or at an outside of the body. The seating portion may be provided in front of the fan mounting portion. The dust container, the dust separator, and the fan mounting portion may be positioned in the length direction of the body, in succession.

The dust separator and the dust container may be mounted to the body individually. The dust container may be formed to surround the dust separator. The dust separator may be secured to the body as the dust container is mounted to the body.

The dust container may include a case and a cover that opens/closes the case, and the cover may be coupled to the body. The cover may form an exterior appearance of the cleaner. Therefore, it may be said that the cover is a body cover.

The cover may be positioned on a top side of the dust separator. The cover may have a transparent window to make an inside of the dust separator visible.

The vacuum cleaner may further include a filter unit or device that filters the air being discharged from the dust separator. The filter unit may be positioned under the dust separator between the dust separator and the fan mounting portion.

The filter unit may form a unitary assembly with the dust separator. The dust container may have an underside in contact with an upper side of the filter unit. The unitary assembly may be secured to the body as the dust container is coupled to the body.

Embodiments disclosed herein further provide a vacuum cleaner, having a dust container, a dust separator, and a body with a fan mounting portion, that may include the dust container, the dust separator, and the fan mounting portion positioned in a length or lengthwise direction of the body in succession, air introduced from a front side of a bottom of the dust separator to the dust separator being discharged from the bottom of a center of the dust separator after having dust separated from the air, and may be introduced to the fan mounting portion, and the dust being introduced to the dust container from an upper side of the dust separator in a tangential direction of a front side of the dust separator. The dust separator and the dust container may be provided individually, and may be mounted to the body in an order, and be separated from the body in a reverse order.

The body may include a suction flow passage provided in a lower side of the body, a body inlet in communication with the suction flow passage to introduce the air to an inside of the body, and a body outlet in communication with the fan mounting portion to discharge the air to an outside of the body.

The dust separator may include a cylindrical unit or device mounted vertically, and a conical unit or device mounted in the cylindrical unit. The cylindrical unit may have a bottom with an air inlet and an air outlet provided thereto, and an upper side provided with a dust discharge portion. The air inlet may be provided in a front side bottom of the dust separator to be in communication with the suction flow passage, and the air outlet may be provided in a center of the bottom of the dust separator to be in communication with the fan mounting portion.

The body inlet, the air inlet, the air outlet, the fan mounting portion, and the body outlet may be provided in the length direction of the body, in succession. The body inlet, the air inlet, the air outlet, and the fan mounting portion may have centers which form a same plane.

The vacuum cleaner may further include an axial flow fan provided to the fan mounting portion, with an air inlet of the axial flow fan faced to a floor. That is, an air inlet to a fan driving unit or device of a fan and a motor face the floor.

Characteristics of the embodiments may be applicable to other embodiments as far as the characteristics are not contrary thereto.

Embodiments disclosed herein provide a vacuum cleaner that may enable easy separation of the dust container from the cleaner and easy cleaning of the same. Embodiments disclosed herein further provide a vacuum cleaner having a dust container which is light and easy to fabricate for convenient use of the vacuum cleaner.

Embodiments disclosed herein provide a vacuum cleaner having a dust container and a dust separator (a cyclone unit or device) provided individually to reduce an effort of a user from unnecessary cleaning by taking a difference of frequencies of cleaning between the dust container and the dust separator into account. Embodiments disclosed herein provide a vacuum cleaner in which a horizontal flow distance and a vertical flow distance, through which air and dust flow may be reduced to reduce flow resistance, thereby enhancing efficiency and reducing noise.

Embodiments disclosed herein provide a vacuum cleaner in which a cyclone unit or device and a filter unit or device may be configured as a single assembly to make the cyclone unit and the filter unit couple to, and separate from, the cleaner easily for using the vacuum cleaner conveniently. Embodiments disclosed herein also provide a vacuum cleaner that may enable easy hold or determination of a contamination level of the cyclone unit in the vacuum cleaner, as well as not to separate the cyclone unit from the cleaner, but to expose the cyclone unit to an outside of the cleaner even if the dust container is separated. With this, unnecessary cleaning of the cyclone unit and/or the filter unit is required no more.

Embodiments disclosed herein provide a very simple dust container. That is, embodiments disclosed herein provide a vacuum cleaner which is convenient to use, in which a case of the dust container may be made to have a very simple inside shape enough to discharge dust only by turning the case upside down. Embodiments disclosed herein also provide a vacuum cleaner that may enable easy hold or determination of contamination of a filter in a filter unit. Embodiments disclosed herein provide a vacuum cleaner in which a dust separator and a dust container may be configured individually such that the dust separator may be secured to the cleaner firmly with the dust container to make the vacuum cleaner easy to use.

It will be apparent to those skilled in the art that various modifications and variations can be made without departing from the spirit or scope of this application. Thus, it is intended that embodiments cover modifications and variations provided they come within the scope of the appended claims and their equivalents.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner, comprising:

a main body;

a dust separator configured to separate dust from air by a cyclone principle;

a dust container configured to hold the dust separated at the dust separator, the dust container being configured to be positioned on the main body, wherein the dust separator is configured to be positioned adjacent to at least one outer surface of the dust container, the dust container being separable from the dust separator; and a filter device provided under the dust separator that filters fine dust from the air discharged from the dust separator, wherein the dust container is seated on an upper side of the filter device.

2. The vacuum cleaner as claimed in claim 1, wherein the main body includes a fan mounting portion configured to receive a fan mounted thereto, and wherein the fan draws air through the dust separator.

3. The vacuum cleaner as claimed in claim 2, wherein the dust separator is configured to be positioned adjacent to the fan mounting portion.

4. The vacuum cleaner as claimed in claim 2, further comprising a seating portion provided at one side of the fan mounting portion configured to receive the dust separator and the dust container mounted thereto.

5. The vacuum cleaner as claimed in claim 4, wherein the seating portion extends from a lower side of the fan mounting portion.

6. The vacuum cleaner as claimed in claim 5, wherein the seating portion includes a suction flow passage in communication with the dust separator.

7. The vacuum cleaner as claimed in claim 6, wherein the seating portion includes a recessed portion having a shape corresponding to a shape of a bottom of the dust separator.

8. The vacuum cleaner as claimed in claim 4, wherein the seating portion includes a coupling portion configured to couple to the dust container.

9. The vacuum cleaner as claimed in claim 2, wherein the fan mounting portion includes an axial flow fan, an air inlet of the axial flow fan facing a floor.

10. The vacuum cleaner as claimed in claim 1, wherein the filter device includes:

a filter frame; and a filter mounted in the filter frame.

11. The vacuum cleaner as claimed in claim 10, wherein the filter frame includes a see-through portion or an opening provided therein through which an inside of the filter frame is visible.

12. The vacuum cleaner as claimed in claim 1, wherein the filter device includes: a first frame having an air inlet in communication with an air outlet in the dust separator; and a second frame in communication with the first frame and in communication with the fan mounting portion, wherein the second frame is inserted into the recessed portion.

13. The vacuum cleaner as claimed in claim 1, whet the dust container is seated on an upper side of the filter device.

14. The vacuum cleaner as claimed in claim 13, wherein a bottom of the dust container and the upper side of the filter device have predetermined gradients for easy attachment/detachment of the dust container to and from the upper side of the filter device.

15. The vacuum cleaner as claimed in claim 1, wherein the dust container is detachable from the main body independently from the dust separator.

16. The vacuum cleaner as claimed in claim 1, wherein the dust container and the dust separator are configured to be mounted on the main body in different directions.

17. The vacuum cleaner as claimed in claim 16, wherein the dust container is configured to be mounted to the main body in a substantially horizontal direction, and the dust separator is configured to be mounted to the main body in a substantially vertical direction.

18. The vacuum cleaner as claimed in claim 1, wherein the dust container has a curved-in portion configured to receive the dust separator positioned therein.

19. The vacuum cleaner as claimed in claim 1, wherein the dust separator is mounted substantially vertically to the main body, and wherein the dust separator has an air inlet provided in a lower side thereof and a dust discharge portion through which the dust separated from the air is discharged.

20. The vacuum cleaner as claimed in claim 19, wherein the dust container includes a dust inlet provided in an upper sider thereof matched to the dust discharge portion in the dust separator.

21. The vacuum cleaner as claimed in claim 19, wherein the dust separator includes a dust discharge guide on an outside of an upper side of the dust separator configured to communicate with the dust container.

22. The vacuum cleaner as claimed in claim 1, further comprising a detachable body cover provided at top sides of the dust separator and the dust container.

23. The vacuum cleaner as claimed in claim 22, wherein the body cover is configured to cover the dust container.

24. The vacuum cleaner as claimed in claim 22, wherein the dust separator includes a detachable dust separator cover, the dust separator cover being provided under the body cover.

25. A vacuum cleaner, comprising:

a main body;

a dust separator configured to be positioned on the main body and separate dust from air by a cyclone principle;

a dust container having a curved-in portion configured to receive the dust separator therein, the dust separator being provided adjacent to and at an outside of the dust container and being separable from the dust container; and a filter device provided under the dust separator that filters fine dust from the air discharged from the dust separator, the dust container is seated on an upper side of the filter device.

26. The vacuum cleaner as claimed in claim 25, wherein the dust container is detachable from the main body independently from the dust separator.

27. The vacuum cleaner as claimed in claim 25, wherein the curved-in portion curves in in a direction opposite to a direction in which the dust container is mounted to the main body.

28. A vacuum cleaner, comprising:

a main body;

a dust separator configured to separate dust from air by a cyclone principle;

a dust container including a case configured to hold the dust separated at the dust separator, wherein the dust container and the dust separator are configured to be positioned on the main body, such that the dust container and dust separator are independently separable from the main body; and a body cover provided at top sides of the dust separator and the dust container, wherein the body cover is configured to open and close the case and form an exterior appearance of the main body.

29. The vacuum cleaner as claimed in claim 28, wherein the dust container and the dust separator are configured to be mounted on the main body in different directions.

30. The vacuum cleaner as claimed in claim 29, wherein the dust container is configured to be mounted to the main body in a substantially horizontal direction, and the dust separator is configured to be mounted to the main body in a substantially vertical direction.

31. The vacuum cleaner as claimed in claim 28, wherein the dust container has a curved-in portion configured to receive the dust separator positioned therein.

32. The vacuum cleaner as claimed in claim 28, further comprising a filter device provided under the dust separator that filters fine dust from the air discharged from the dust separator.

33. The vacuum cleaner as claimed in claim 32, wherein the dust container is seated on an upper side of the filter device.

* * * * *